US011745320B2

(12) United States Patent
Chen

(10) Patent No.: US 11,745,320 B2
(45) Date of Patent: Sep. 5, 2023

(54) TORQUE WRENCH

(71) Applicant: INFAR INDUSTRIAL CO., LTD., Chang-Hua County (TW)

(72) Inventor: Tai Hung Chen, Chang-Hua County (TW)

(73) Assignee: INFAR INDUSTRIAL CO., LTD., Chang-Hua County (TW)

( * ) Notice: Subject to any disclaimer, the term of this patent is extended or adjusted under 35 U.S.C. 154(b) by 142 days.

(21) Appl. No.: 17/342,661

(22) Filed: Jun. 9, 2021

(65) Prior Publication Data

US 2022/0143794 A1 May 12, 2022

(30) Foreign Application Priority Data

Nov. 12, 2020 (TW) ..... 109214941

(51) Int. Cl.
*B25B 23/142* (2006.01)
*B25B 23/16* (2006.01)
*B25B 23/14* (2006.01)

(52) U.S. Cl.
CPC ..... *B25B 23/1427* (2013.01); *B25B 23/141* (2013.01); *B25B 23/16* (2013.01)

(58) Field of Classification Search
CPC ... B25B 23/16; B25B 23/141; B25B 23/1427; F16B 7/042; F16B 7/1409; F16L 37/00; F16L 37/28; F16L 21/08
USPC ..... 81/467, 474, 478, 481
See application file for complete search history.

(56) References Cited

U.S. PATENT DOCUMENTS 6,354,629 B1 * 3/2002 McNeal ..... A63C 11/221 280/820
2014/0202292 A1 * 7/2014 Chen ..... B25B 13/463 81/478
2018/0141193 A1 * 5/2018 Chen ..... B25B 23/1427

* cited by examiner

*Primary Examiner* — Brian D Keller
*Assistant Examiner* — Robert C Moore
(74) *Attorney, Agent, or Firm* — Alan D. Kamrath; Karin L. Williams; Mayer & Williams PC

(57) ABSTRACT

A torque wrench has a lock device, which includes a locking sleeve, a restoring elastic member, a clamping member, a locking hole, a locking member, and a positioning assembly. The locking sleeve is provided with an accommodating recess, an abutting portion, and a positioning recess. When the lock device is in a lock position, the locking member is pushed by the abutting portion and pressed against a hollow shank to restrict a handle from rotating relative to the hollow shank. When the lock device is in an unlock position, the locking member is detached from the abutting portion, so that the handle is rotatable relative to the hollow shank.

9 Claims, 7 Drawing Sheets

TORQUE WRENCH

BACKGROUND OF THE INVENTION

The present invention relates to a torque wrench and, more particularly, to a torque wrench that has a lock device and allows quick setting a torque limit value.

The conventional torque wrench includes a hollow shank, a wrench member mounted at one end of the shank for driving a workpiece, an adjustable grip member rotatably mounted at an opposite end of the shank, and a clutch assembly and a spring member arranged in the shank and disposed between the wrench member and the grip member. The grip member can be rotated to push against the spring member, thereby changing a prestress of the spring member for setting a torque limit value. The clutch assembly can be separated when the wrench member withstands a torque larger than the torque limit value, thereby limiting the torque applied on the wrench member. Further, a percussion sound will be produced to provide notice to a user that the applied force is over the limit.

However, it is necessary to provide a lock device to prevent the grip member from being accidentally rotated to change the torque limit value during the operation of the torque wrench. In addition, when setting the torque limit value, the clutch assembly must be moved relative to the shank, so the friction between the clutch assembly and the shank will affect the user to apply the force to rotate the grip member.

In view of the above, a need exists for a novel torque wrench that mitigates and/or obviates the above drawbacks.

BRIEF SUMMARY OF THE INVENTION

A torque wrench according to the present invention includes a hollow shank, a driving rod, a handle, a torque elastic member, a clutch assembly, and a lock device. The hollow shank has a first end, a second end opposite to the first end, and a plurality of locking recesses arranged around an outer periphery of the second end. The driving rod is inserted and pivotally connected to the first end of the hollow shank. The handle is rotatably connected to the second end of the hollow shank. An adjusting threaded member is disposed in the handle and is threaded connected to the second end of the hollow shank. The torque elastic member is disposed in the hollow shank and abuts against the adjusting threaded member. The clutch assembly is disposed between the driving rod and the torque elastic member and is pushed by the torque elastic member to produce a clutch action. The lock device is movable relative to the hollow shank between a lock position and an unlock position. The lock device includes a locking sleeve movably sleeved on the handle, a restoring elastic member arranged between the locking sleeve and the handle, a clamping member clamping around an outer periphery of the handle, at least one locking hole arranged on the handle, at least one locking member movably disposed in the at least one locking hole, and a positioning assembly disposed between the locking sleeve and the handle. An inner wall of the locking sleeve is provided with an accommodating recess, an abutting portion formed at one side of the accommodating recess, and a positioning recess.

When the lock device is in the lock position, the at least one locking member is pushed by the abutting portion to abut against one of the plurality of locking recesses to restrict the handle from rotating relative to the hollow shank, and the positioning assembly abuts against the inner wall of the locking sleeve.

When the lock device is in the unlock position, the locking member is detached from the abutting portion and is movable between the accommodating recess and one of the plurality of locking recesses, so that the handle is rotatable relative to the hollow shank, and the positioning assembly engages in the positioning recess.

In an example, the positioning assembly includes a positioning ring sleeved on the handle, at least one positioning hole penetrating outer and inner peripheries of the positioning ring, at least one positioning member movably disposed in the at least one positioning hole, and at least one positioning elastic member disposed in the at least one positioning hole. The at least one positioning member is selectively engaged in the positioning recess as the locking sleeve moves relative to the handle. Two opposite ends of the at least one positioning elastic member respectively abut against the outer periphery of the handle and the at least one positioning member.

In an example, the outer periphery of the handle is provided with a clamping groove, and the clamping member is engaged in the clamping groove.

In an example, the locking sleeve is further provided with an elastic member recess disposed between the abutting portion and the positioning recess. The restoring elastic member is arranged in the elastic member recess and is selectively compressed by the abutting portion as the locking sleeve moves relative to the handle.

In an example, the outer periphery of the handle is provided with an engaging groove. One end of the locking sleeve is provided with an engaging portion adjacent to the accommodating recess, and the engaging portion is selectively engaged in the engaging groove as the locking sleeve moves relative to the handle.

In an example, the locking sleeve is provided with an inclined surface formed on a side of the abutting portion adjacent to the accommodating recess, and the inclined surface selectively abuts against the locking member as the locking sleeve moves relative to the handle.

In an example, the clutch assembly includes a first clutch member arranged at one end of the driving rod, a second clutch member clutchably connected with the first clutch member, a clutch seat abutted on one end of the torque elastic member, and a clutch shaft inserted through the second clutch member and the clutch seat. The clutch seat has a clutch hole, and the second clutch member is rotatably arranged in the clutch hole to produce the clutch action with the first clutch member.

In an example, the first clutch member is formed as a column shape and is embedded at one end of the driving rod. The second clutch member is formed as a column shape and clutchably abuts against the first clutch member.

In an example, an outer periphery of the clutch seat is provided with at least one ball recess, and at least one ball capable of rolling relative to the clutch seat is arranged in the at least one ball recess.

In an example, the adjusting threaded member has an adjusting end opposite to the torque elastic member, and the adjusting end has a polygonal cross-sectional shape.

The present invention will become clearer in light of the following detailed description of illustrative embodiments of this invention described in connection with the drawings.

DETAILED DESCRIPTION OF THE INVENTION

Figure 1:
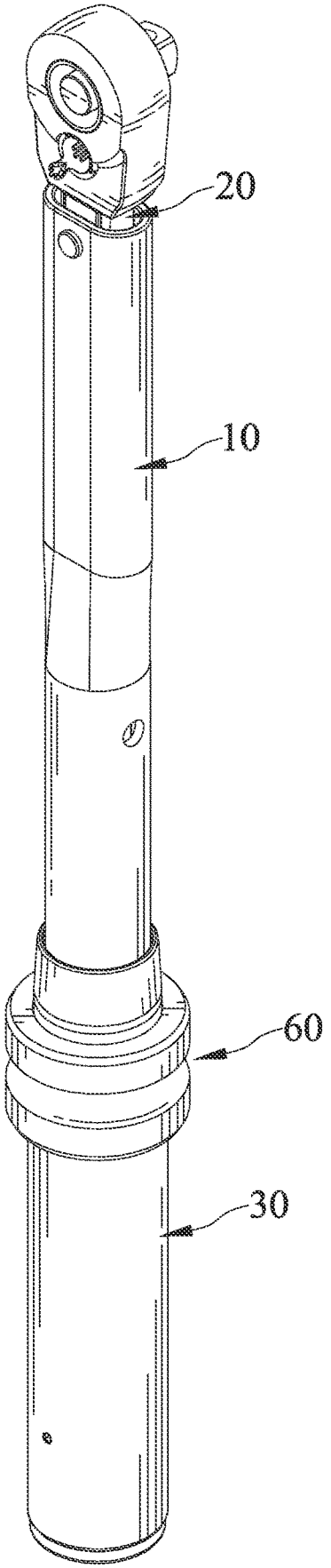
FIG. 1 is a perspective view of a torque wrench of an embodiment according to the present invention.
Figure 2:
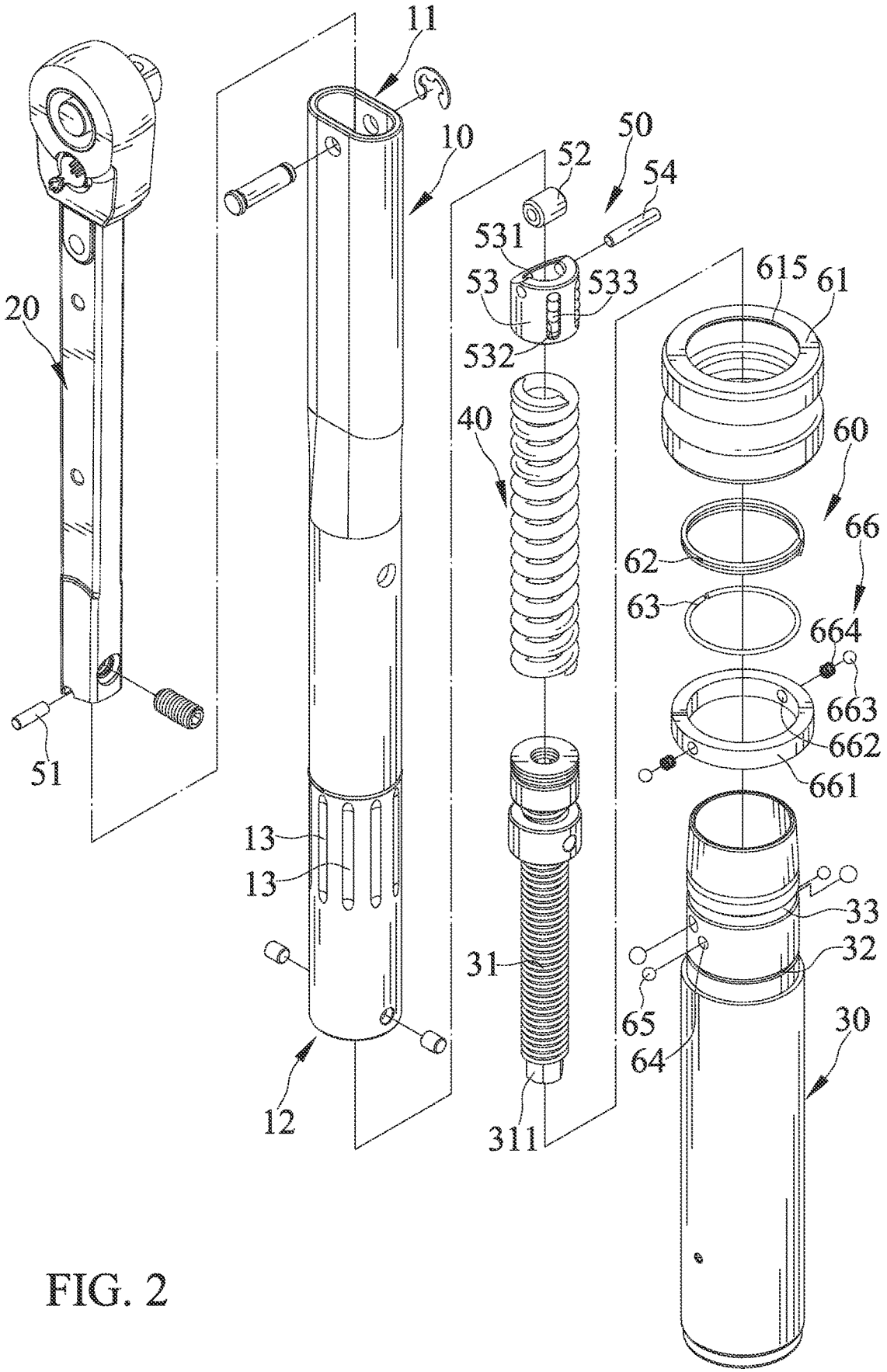
FIG. 2 is an exploded, perspective views of the torque wrench of FIG. 1.
Figure 3:
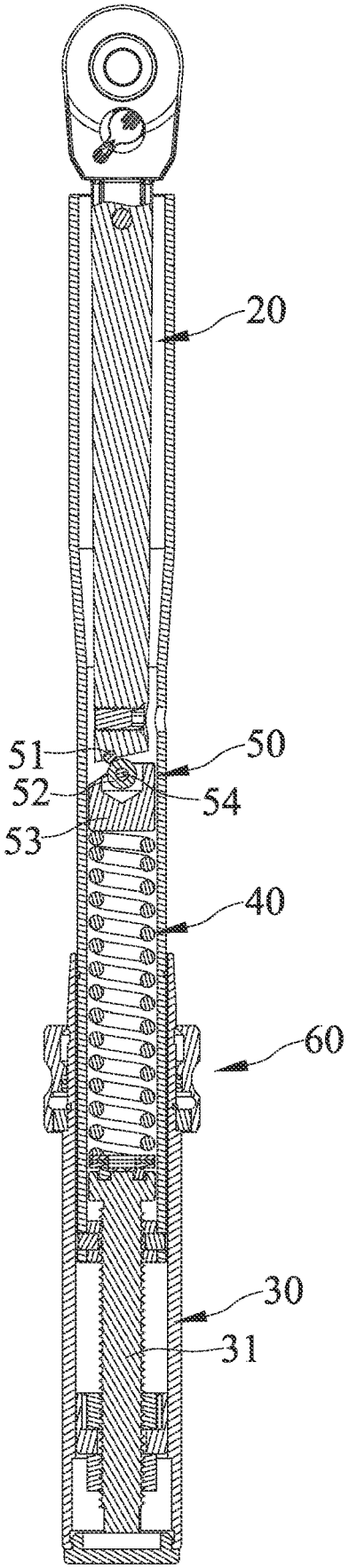
FIG. 3 is a cross-sectioned view of the torque wrench of FIG. 1.
Figure 4:
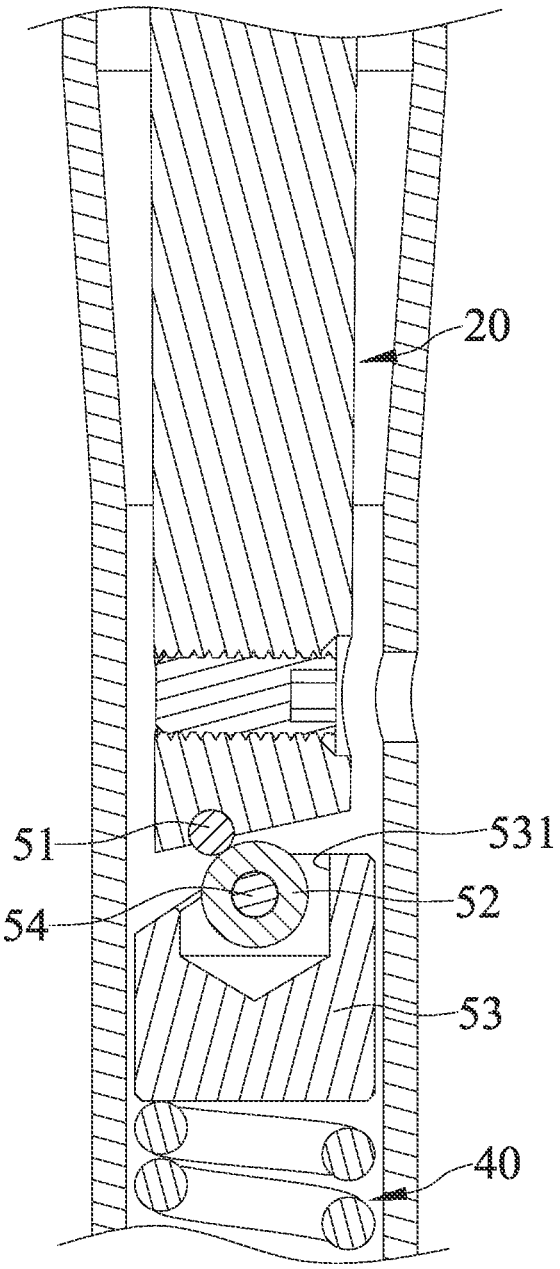
FIG. 4 is a partial enlarged view of FIG. 3.
Figure 5:
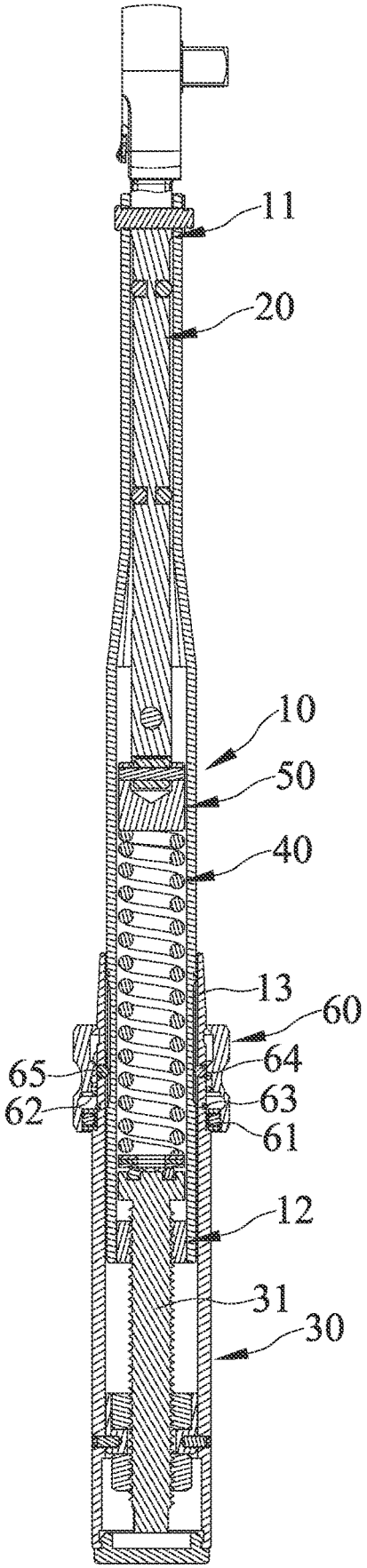
FIG. 5 is another cross-sectioned view of the torque wrench of FIG. 1.

FIGS. 1-7 show a torque wrench of an embodiment according to the present invention. The torque wrench includes a hollow shank 10, a driving rod 20, a handle 30, a torque elastic member 40, a clutch assembly 50, and a lock device 60.

The hollow shank 10 has a first end 11, a second end 12 opposite to the first end 11, and a plurality of locking recesses 13 arranged around an outer periphery of the second end 12. Further, each locking recess 13 may be extended along a longitudinal direction of the hollow shank 10 and is formed on the outer periphery of the second end 12 around a longitudinal axis of the hollow shank 10.

The driving rod 20 is inserted and pivotally connected to the first end 11 of the hollow shank 10 and can connect and drive a workpiece to be driven (not shown).

The handle 30 is rotatably connected to the second end 12 of the hollow shank 10, and an adjusting threaded member 31 is disposed in the handle 30 and is threaded connected to the second end 12 of the hollow shank 10. The adjusting threaded member 31 is moved relative to the hollow shank 10 by rotating the handle 30 to change a prestress received by the torque elastic member 40 to adjust a preset torque limit value. Further, the adjusting threaded member 31 has an adjusting end 311 opposite to the torque elastic member 40, and the adjusting end 311 has a polygonal cross-sectional shape so that the adjusting end 311 can be adjusted by standard socket tools without other jigs. The torque elastic member 40 is disposed in the hollow shank 10 and abuts against the adjusting threaded member 31.

The clutch assembly 50 is disposed between the driving rod 20 and the torque elastic member 40 and is pushed by the torque elastic member 40 to produce a clutch action, thereby restricting whether the driving rod 20 applies torque to the workpiece or not. In the embodiment, the clutch assembly 50 includes a first clutch member 51 arranged at one end of the driving rod 20, a second clutch member 52 clutchably connected with the first clutch member 51, a clutch seat 53 abutted on one end of the torque elastic member 40, and a clutch shaft 54 inserted through the second clutch member 52 and the clutch seat 53. The first clutch member 51 is formed as a column shape and is embedded at one end of the driving rod 20, and the second clutch member 52 is formed as a column shape and clutchably abuts against the first clutch member 51. The clutch seat 53 can strike an inner surface of the hollow shank 10 as the clutch action to produce a notice percussion sound. The clutch seat 53 has a clutch hole 531, and the second clutch member 52 is rotatably arranged in the clutch hole 531 to produce the clutch action with the first clutch member 51. Further, an outer periphery of the clutch seat 53 is provided with at least one ball recess 532, and at least one ball 533 capable of rolling relative to the clutch seat 53 is arranged in the ball recess 532. Thus, the ball 533 is suitable for rolling contact with the inner surface of the hollow shank 10, and can reduce the friction between the clutch seat 53 and the hollow shank 10, so as to reduce the force of adjusting the preset torque limit value.

The lock device 60 is movable relative to the hollow shank 10 between a lock position and an unlock position. The lock device 60 includes a locking sleeve 61 movably sleeved on the handle 30, a restoring elastic member 62 arranged between the locking sleeve 61 and the handle 30, a clamping member 63 clamping around an outer periphery of the handle 30, at least one locking hole 64 arranged on the handle 30, at least one locking member 65 movably disposed in the locking hole 64, and a positioning assembly 66 disposed between the locking sleeve 61 and the handle 30. An inner wall of the locking sleeve 61 is provided with an accommodating recess 611, an abutting portion 612 formed at one side of the accommodating recess 611, and a positioning recess 613. The outer periphery of the handle 30 is provided with a clamping groove 32, and the clamping member 63 is engaged in the clamping groove 32. The locking sleeve 61 is further provided with an elastic member recess 614 disposed between the abutting portion 612 and the positioning recess 613. The restoring elastic member 62 is arranged in the elastic member recess 614 and is selectively compressed by the abutting portion 612 as the locking sleeve 61 moves relative to the handle 30. The outer periphery of the handle 30 is provided with an engaging groove 33. One end of the locking sleeve 61 is provided with an engaging portion 615 adjacent to the accommodating recess 611, and the engaging portion 615 is selectively engaged in the engaging groove 33 as the locking sleeve 61 moves relative to the handle 30. The locking sleeve 61 is provided with an inclined surface 616 formed on a side of the abutting portion 612 adjacent to the accommodating recess 611. The inclined surface 616 selectively abuts against the locking member 65 as the locking sleeve 61 moves relative to the handle 30.

Furthermore, the positioning assembly 66 includes a positioning ring 661 sleeved on the handle 30, at least one positioning hole 662 penetrating outer and inner peripheries of the positioning ring 661, at least one positioning member 663 movably disposed in the positioning hole 662, and at least one positioning elastic member 664 disposed in the positioning hole 662. The positioning member 663 is selectively engaged in the positioning recess 613 as the locking sleeve 61 moves relative to the handle 30. Two opposite ends of the positioning elastic member 664 respectively abut against the outer periphery of the handle 30 and the positioning member 663.

Figure 6:
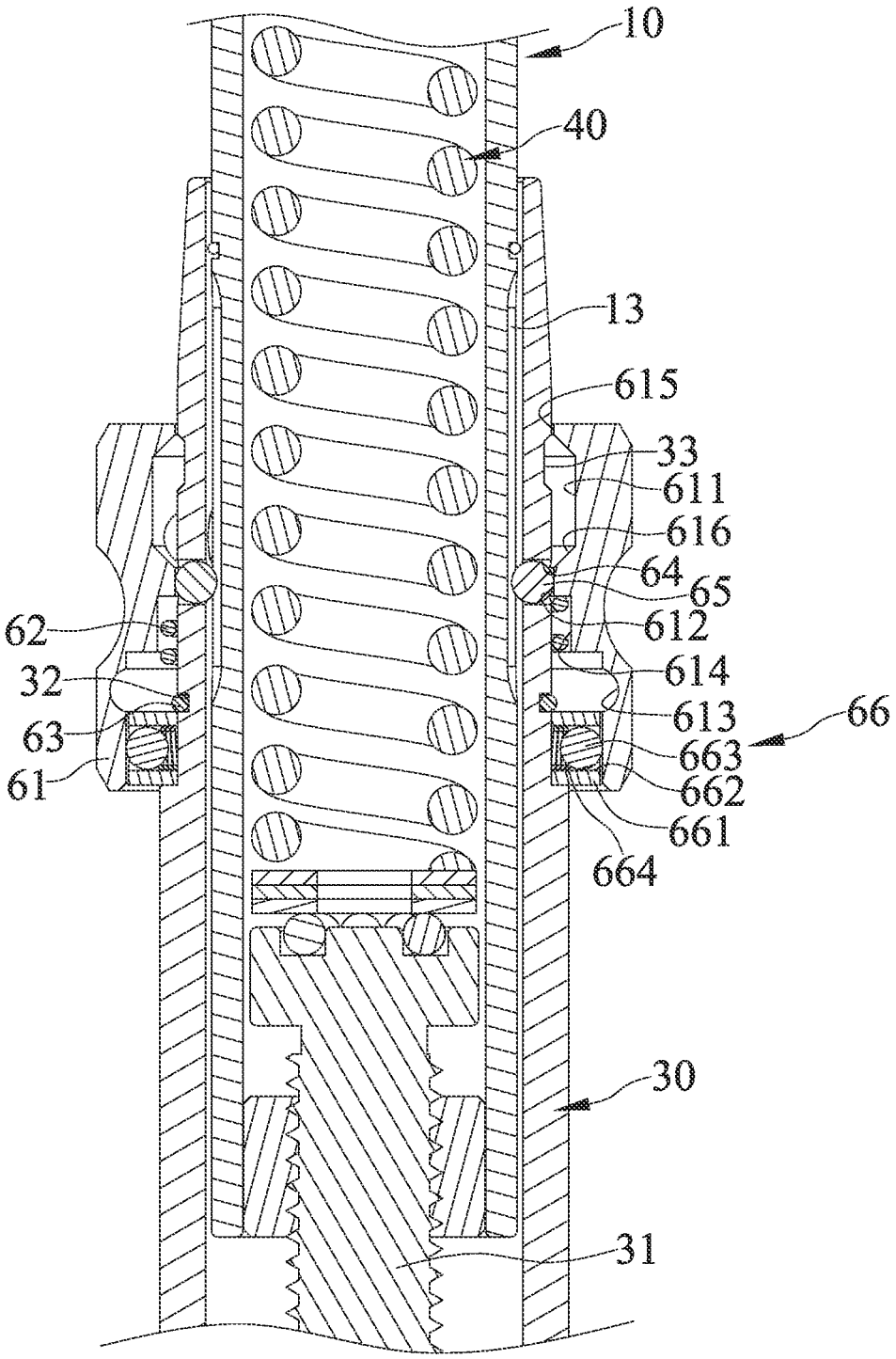
FIG. 6 is a partial enlarged view of FIG. 5.

FIG. 6 illustrates the lock device 60 in the lock position. When the lock device 60 is in the lock position, the locking member 65 is pushed by the abutting portion 612 to abut against one of the locking recesses 13 to restrict the handle 30 from rotating relative to the hollow shank 10, and the positioning assembly 66 abuts against the inner wall of the locking sleeve 61.

Figure 7:
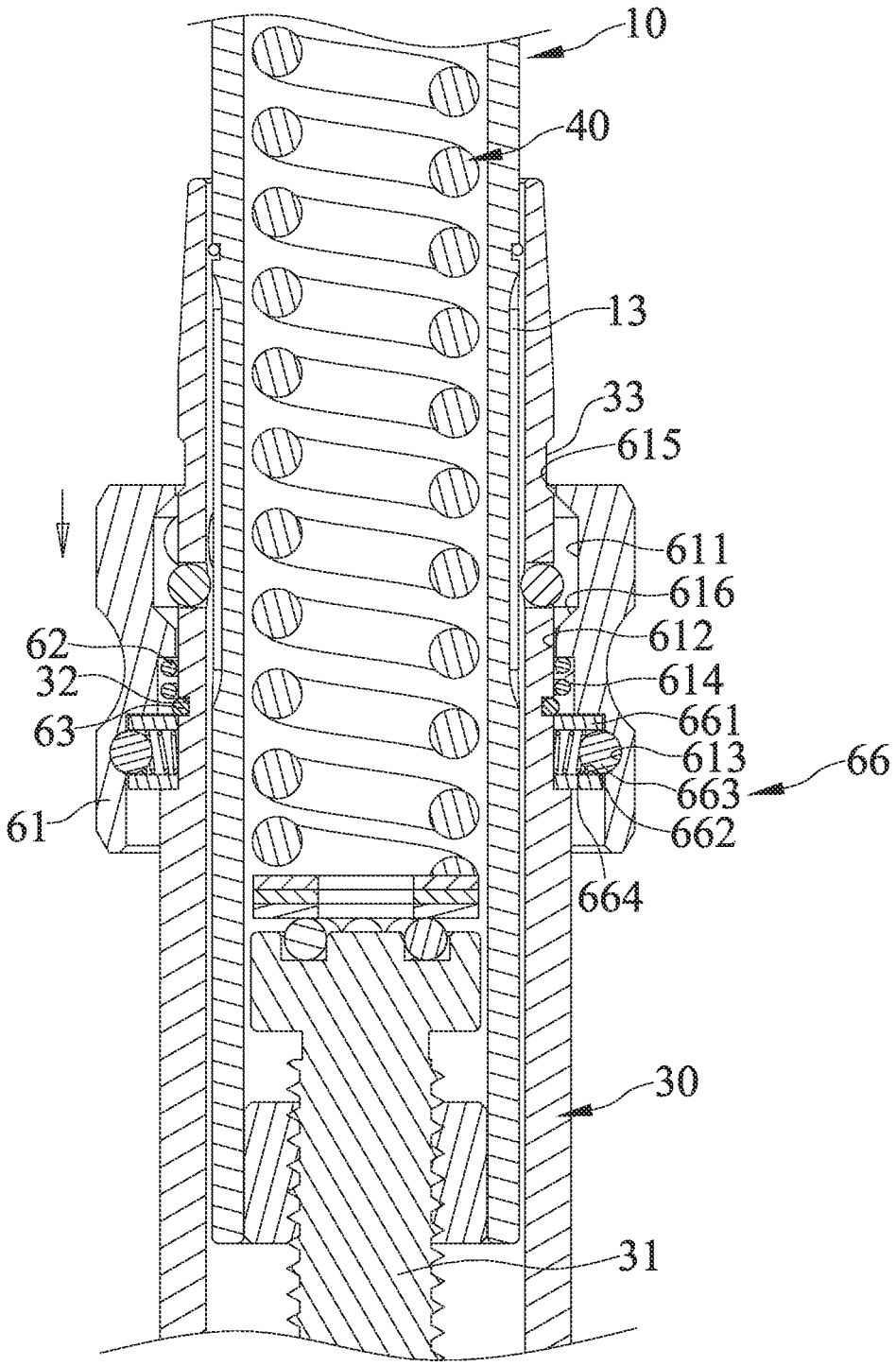
FIG. 7 is a continued view of view of FIG. 6 and illustrates a lock device moved from a lock position to an unlock position.

FIG. 7 illustrates the locking sleeve 61 of the lock device 60 to be pushed to move from the lock position to the unlock position. When the lock device 60 is in the unlock position, the locking member 65 is detached from the abutting portion 612 and is movable between the accommodating recess 611 and one of the plurality of locking recesses 13, so that the handle 30 is rotatable relative to the hollow shank 10. The positioning assembly 66 engages in the positioning recess 613 to prevent accidentally resetting the locking sleeve 61 from the unlock position to the lock position. In addition, the restoring elastic member 62 is located in the elastic member recess 614 and is compressed by one side of the abutting portion 612, and the engaging portion 615 is clamped in the engaging groove 33.

Although specific embodiments have been illustrated and described, numerous modifications and variations are still possible without departing from the scope of the invention. The scope of the invention is limited by the accompanying claims.

The invention claimed is:

1. A torque wrench comprising:

a hollow shank having a first end, a second end opposite to the first end, and a plurality of locking recesses arranged around an outer periphery of the second end;

a driving rod inserted and pivotally connected to the first end of the hollow shank;

a handle rotatably connected to the second end of the hollow shank, and wherein an adjusting threaded member is disposed in the handle and is threaded connected to the second end of the hollow shank;

a torque elastic member disposed in the hollow shank and abutting against the adjusting threaded member;

a clutch assembly disposed between the driving rod and the torque elastic member and pushed by the torque elastic member to produce a clutch action; and a lock device movable relative to the hollow shank between a lock position and an unlock position, wherein the lock device includes a locking sleeve movably sleeved on the handle, a restoring elastic member arranged between the locking sleeve and the handle, a clamping member clamping around an outer periphery of the handle, at least one locking hole arranged on the handle, at least one locking member movably disposed in the at least one locking hole, and a positioning assembly disposed between the locking sleeve and the handle, and wherein an inner wall of the locking sleeve is provided with an accommodating recess, an abutting portion formed at one side of the accommodating recess, and a positioning recess, wherein when the lock device is in the lock position, the at least one locking member is pushed by the abutting portion to abut against one of the plurality of locking recesses to restrict the handle from rotating relative to the hollow shank, and wherein the positioning assembly abuts against the inner wall of the locking sleeve, wherein when the lock device is in the unlock position, the locking member is detached from the abutting portion and is movable between the accommodating recess and one of the plurality of locking recesses, so that the handle is rotatable relative to the hollow shank, and wherein the positioning assembly engages in the positioning recess, and wherein the positioning assembly includes a positioning ring sleeved on the handle, at least one positioning hole penetrating outer and inner peripheries of the positioning ring, at least one positioning member movably disposed in the at least one positioning hole, and at least one positioning elastic member disposed in the at least one positioning hole, wherein the at least one positioning member is selectively engaged in the positioning recess as the locking sleeve moves relative to the handle, and wherein two opposite ends of the at least one positioning elastic member respectively abut against the outer periphery of the handle and the at least one positioning member.

2. The torque wrench as claimed in claim 1, wherein the outer periphery of the handle is provided with a clamping groove, and wherein the clamping member is engaged in the clamping groove.

3. The torque wrench as claimed in claim 2, wherein the locking sleeve is further provided with an elastic member recess disposed between the abutting portion and the positioning recess, and wherein the restoring elastic member is arranged in the elastic member recess and is selectively compressed by the abutting portion as the locking sleeve moves relative to the handle.

4. The torque wrench as claimed in claim 3, wherein the outer periphery of the handle is provided with an engaging groove, wherein one end of the locking sleeve is provided with an engaging portion adjacent to the accommodating recess, and wherein the engaging portion is selectively engaged in the engaging groove as the locking sleeve moves relative to the handle.

5. The torque wrench as claimed in claim 4, wherein the locking sleeve is provided with an inclined surface formed on a side of the abutting portion adjacent to the accommodating recess, and wherein the inclined surface selectively abuts against the locking member as the locking sleeve moves relative to the handle.

6. The torque wrench as claimed in claim 5, wherein the clutch assembly includes a first clutch member arranged at one end of the driving rod, a second clutch member clutchably connected with the first clutch member, a clutch seat abutted on one end of the torque elastic member, and a clutch shaft inserted through the second clutch member and the clutch seat, wherein the clutch seat has a clutch hole, and wherein the second clutch member is rotatably arranged in the clutch hole to produce the clutch action with the first clutch member.

7. The torque wrench as claimed in claim 6, wherein the first clutch member is formed as a column shape and is embedded at one end of the driving rod, and wherein the second clutch member is formed as a column shape and clutchably abuts against the first clutch member.

8. The torque wrench as claimed in claim 6, wherein an outer periphery of the clutch seat is provided with at least one ball recess, wherein at least one ball capable of rolling relative to the clutch seat is arranged in the at least one ball recess.

9. The torque wrench as claimed in claim 1, wherein the adjusting threaded member has an adjusting end opposite to the torque elastic member, and wherein the adjusting end has a polygonal cross-sectional shape.

* * * * *